US009664013B2

(12) United States Patent
Coffey et al.

(10) Patent No.: US 9,664,013 B2
(45) Date of Patent: May 30, 2017

(54) WELLBORE SUBASSEMBLIES AND METHODS FOR CREATING A FLOWPATH

(71) Applicant: Nine Energy Canada, Inc., Calgary (CA)

(72) Inventors: Nathan Brian Coffey, Grand Prairie (CA); Terry Lee Mytopher, Grand Prairie (CA)

(73) Assignee: Nine Energy Canada Inc. (CA)

( * ) Notice: Subject to any disclaimer, the term of this patent is extended or adjusted under 35 U.S.C. 154(b) by 639 days.

(21) Appl. No.: 13/815,205

(22) Filed: Feb. 8, 2013

(65) Prior Publication Data

US 2014/0000894 A1 Jan. 2, 2014

Related U.S. Application Data

(63) Continuation-in-part of application No. 12/804,517, filed on Jul. 23, 2010, now Pat. No. 8,622,132, and a continuation-in-part of application No. 13/136,085, filed on Jul. 22, 2011, now Pat. No. 8,950,509, which is a continuation-in-part of application No. 12/804,517, filed on Jul. 23, 2010, now Pat. No. 8,622,132.

(60) Provisional application No. 61/228,460, filed on Jul. 24, 2009, provisional application No. 61/230,468, filed on Jul. 31, 2009.

(51) Int. Cl.
*E21B 43/117* (2006.01)

(52) U.S. Cl.
CPC ..... *E21B 43/117* (2013.01)

(58) Field of Classification Search
CPC . E21B 43/116; E21B 43/117; E21B 43/11852
See application file for complete search history.

(56) References Cited

U.S. PATENT DOCUMENTS

| | | | |
|---|---|---|---|
| 2,980,017 | A | 7/1953 | Castel |
| 3,329,218 | A | 7/1967 | Bell |
| 4,299,287 | A | 11/1981 | Vann |
| 4,756,371 | A | 7/1988 | Brieger |
| 1,794,990 | A | 1/1989 | Riggs |

(Continued)

FOREIGN PATENT DOCUMENTS

| | | |
|---|---|---|
| CN | 201187287 | 1/2009 |
| RU | 2185498 | 7/2002 |

OTHER PUBLICATIONS

International Search Report for Patent Application No. PCT/IB2010/002163 dated Jan. 13 2011 (8 pages).

*Primary Examiner* — Robert E Fuller
(74) *Attorney, Agent, or Firm* — Vinson & Elkins LLP

(57) ABSTRACT

Wellbore subassemblies usable to create a flowpath between a formation and a wellbore can include an inner sleeve and an outer sleeve positioned internal to and external of a core, the core having sockets containing charge assemblies. Upon actuation of the charge assemblies, the inner and outer sleeves are both simultaneously penetrated to form a fluid flowpath between the interior of the subassembly and the formation exterior to the subassembly. The structure of the subassembly can enable it to be lowed and used as part of a tubular conduit string both before and after perforation, the charge assemblies being unobtrusively embedded within the wall of the subassembly.

11 Claims, 3 Drawing Sheets

(56) References Cited

U.S. PATENT DOCUMENTS

| | | | | |
|---|---|---|---|---|
| 4,850,438 | A * | 7/1989 | Regalbuto | E21B 43/117 102/310 |
| 4,969,525 | A | 11/1990 | George | |
| 5,449,039 | A | 9/1995 | Hartley | |
| 5,660,232 | A | 8/1997 | Reinhardt | |
| 6,009,947 | A | 1/2000 | Wilson | |
| 6,220,355 | B1 | 4/2001 | French | |
| 6,386,288 | B1 | 5/2002 | Snider | |
| 6,394,184 | B2 | 5/2002 | Tolman | |
| 6,536,524 | B1 | 3/2003 | Snider | |
| 6,557,636 | B2 | 5/2003 | Cernocky | |
| 6,672,405 | B2 | 1/2004 | Tolman | |
| 6,761,219 | B2 | 7/2004 | Snider | |
| 6,962,202 | B2 | 11/2005 | Bell | |
| 7,152,676 | B2 | 12/2006 | Vella | |
| 7,461,580 | B2 | 12/2008 | Bell | |
| 7,621,342 | B2 | 11/2009 | Walker | |
| 8,127,832 | B1 * | 3/2012 | Bond | 166/63 |
| 8,151,882 | B2 | 4/2012 | Grigar | |
| 2005/0167108 | A1 * | 8/2005 | Chang | E21B 43/117 166/298 |
| 2014/0123841 | A1 * | 5/2014 | Clay | E21B 43/117 89/1.15 |

* cited by examiner

WELLBORE SUBASSEMBLIES AND METHODS FOR CREATING A FLOWPATH

CROSS REFERENCE TO RELATED APPLICATIONS

This application is a continuation-in-part application that is related to and claims the benefit of the co-pending United States patent application having the Ser. No. 12/804,517, filed Jul. 23, 2010, and the co-pending United States patent application having the Ser. No. 13/136,085, filed Jul. 22, 2011, both of which claim priority to the United States provisional application having the Ser. No. 61/228,460, filed Jul. 24, 2009, and the United States provisional application having the Ser. No. 61/230,468, filed Jul. 31, 2009. Each of the above-referenced applications is incorporated by reference herein in their entirety.

TECHNICAL FIELD

The present invention relates, generally, to wellbore subassemblies and methods for creating a flowpath between a space exterior to the subassembly and an interior space thereof, and more specifically, to wellbore subassemblies and methods of perforating a formation using a wellbore subassembly, to create a flowpath between the formation and the wellbore.

BACKGROUND

A wellbore generally refers to a hole drilled into the earth for the extraction of hydrocarbon-based materials such as, for example, oil and natural gas. Because the term "wellbore" generally includes the open hole or uncased portion of a well, the term "wellbore" typically refers to the space bounded by the wellbore wall—that is, the face of the geological formation that bounds the drilled hole. A wellbore is sometimes referred to as a "borehole."

A perforation is the communication tunnel created from the casing or liner into the reservoir formation, through which oil or gas is produced. The most common method of perforating uses jet perforating guns equipped with shaped explosive charges. However, other perforating methods include bullet perforating, abrasive jetting or high-pressure fluid jetting. Perforation density is the number of perforations per linear foot. The term perforation density is used to describe the configuration of perforating guns or the placement of perforations, and is often abbreviated to spf (shots per foot). An example would be an 8 spf perforating gun. Perforation penetration is a measure, or indicator, of the length that a usable perforation tunnel extends beyond the casing or liner into the reservoir formation. In most cases, a high penetration is desirable to enable access to that part of the formation that has not been damaged by the drilling or completion processes. Perforation phasing is the radial distribution of successive perforating charges around the gun axis. Perforating gun assemblies are commonly available in 0-, 180-, 120-, 90- and 60-degree phasing. The 0-degree phasing is generally used only in small outside-diameter guns, while 60, 90 and 120 degree phase guns are generally larger but provide more efficient flow characteristics near the wellbore.

A perforating gun is a device used to perforate oil and gas wells in preparation for well production. Such guns typically contain several shaped explosive charges and are available in a range of sizes and configurations. The diameter of the gun used is typically determined by the presence of wellbore restrictions or limitations imposed by the surface equipment. The perforating gun, fitted with shaped charges or bullets, is lowered to the desired depth in a well and fired to create penetrating holes in casing, cement, and formation. Thus, to perforate is to pierce the casing wall and cement of a wellbore to provide holes through which formation fluids may enter or to provide holes in the casing so that materials may be introduced into the annulus between the casing and the wall of the borehole.

Current drilling has focused more on directional drilling. Directional drilling results in the creation of lateral well bores. Lateral well bores create many difficulties including difficulties with respect to perforating. It is appreciated that arcuate and lateral portions of a well bore create specific problems, especially with respect to perforating. Further, the longer the lateral portions of the well bore, the more difficult it is to achieve effective perforations. Thus, as drilling practices are directed more toward directional drilling, and directional drilling creates more and longer lateral well bores, the need for effective perforating techniques is greatly increased. The need for effective perforating techniques has long existed and the need increases proportionately with the increase in directional drilling.

There has been a long felt need to perforate accurately and efficiently. The types of charges available have restricted such perforating. The available charges are a restriction to enhancing the performance of the perforation.

The characteristics of the perforation have been and continue to be inferior. Particularly, the need for a continuous, normal perforation, free from disruption, has long been sought after, but not achieved.

The ability to enhance the performance of the perforation has long eluded the art. Especially, the ability to assist and aid the existing charges in the enhancement of the capacity and forcefulness of the perforation has long been desired.

Conventional perforating guns are lowered, via coiled tubing or a similar conduit within a pre-existing casing string, to a desired depth, actuated to perforate in an outward direction, through the casing and into the formation, then removed to allow for production from the formation. As such, current perforating practices require much equipment and manpower. For example, the use of coiled tubing to initiate the perforating process is costly, time consuming, laden with the need for manpower, and prone to have safety problems.

Alternatives to conventional perforating guns include various casing-conveyed systems, typically attached to or otherwise positioned relative to the exterior of the casing, then actuated to penetrate inward into the casing wall. Current perforating devices adapted for conveyance during casing installation are problematic. Such perforating devices require secondary control lines that extend to the surface, and are tedious to install and use. It is long desired to have a "disappearing" perforating gun that is unobtrusive after it has been used.

BRIEF DESCRIPTION OF DRAWINGS

The accompanying drawings, which are incorporated in and constitute a part of this specification, illustrate an implementation of apparatus consistent with the present invention and, together with the detailed description, serve to explain advantages and principles consistent with the invention.

DESCRIPTION OF EMBODIMENTS

Embodiments usable within the scope of the present disclosure include wellbore subassemblies that are, effectively, part of a tubular string (e.g., casing) to which they are secured (e.g., threaded to adjacent tubular joints). As such, embodiments described herein can provide alternatives to conventional tubing-conveyed perforating guns, as well as to external casing-conveyed systems, creating a "disappearing" perforating gun that becomes, essentially, a portion of the tubular conduit of which it is a part after use. In a preferred embodiment, a wellbore subassembly can include a tubular body having a wall, with one or more cavities therein, that defines an interior space (e.g., the axial bore within the body) and an exterior space (e.g., the portion of the formation outside of the body), with one or more charge assemblies positioned in respective cavities of the body (e.g., such that the charge assemblies are embedded within the wall of the subassembly). For example, an outer sleeve and an inner sleeve could be positioned external to and internal of a tubular core, respectively, the tubular core having the cavities formed therein for containing charge assemblies. Actuation of the charge assemblies can thereby create a flowpath between the interior and exterior spaces (e.g., by perforating through the outer and/or inner sleeves, and/or through a portion of the tubular body, and/or cement surrounding the wellbore, and/or into the formation).

Figure 1:
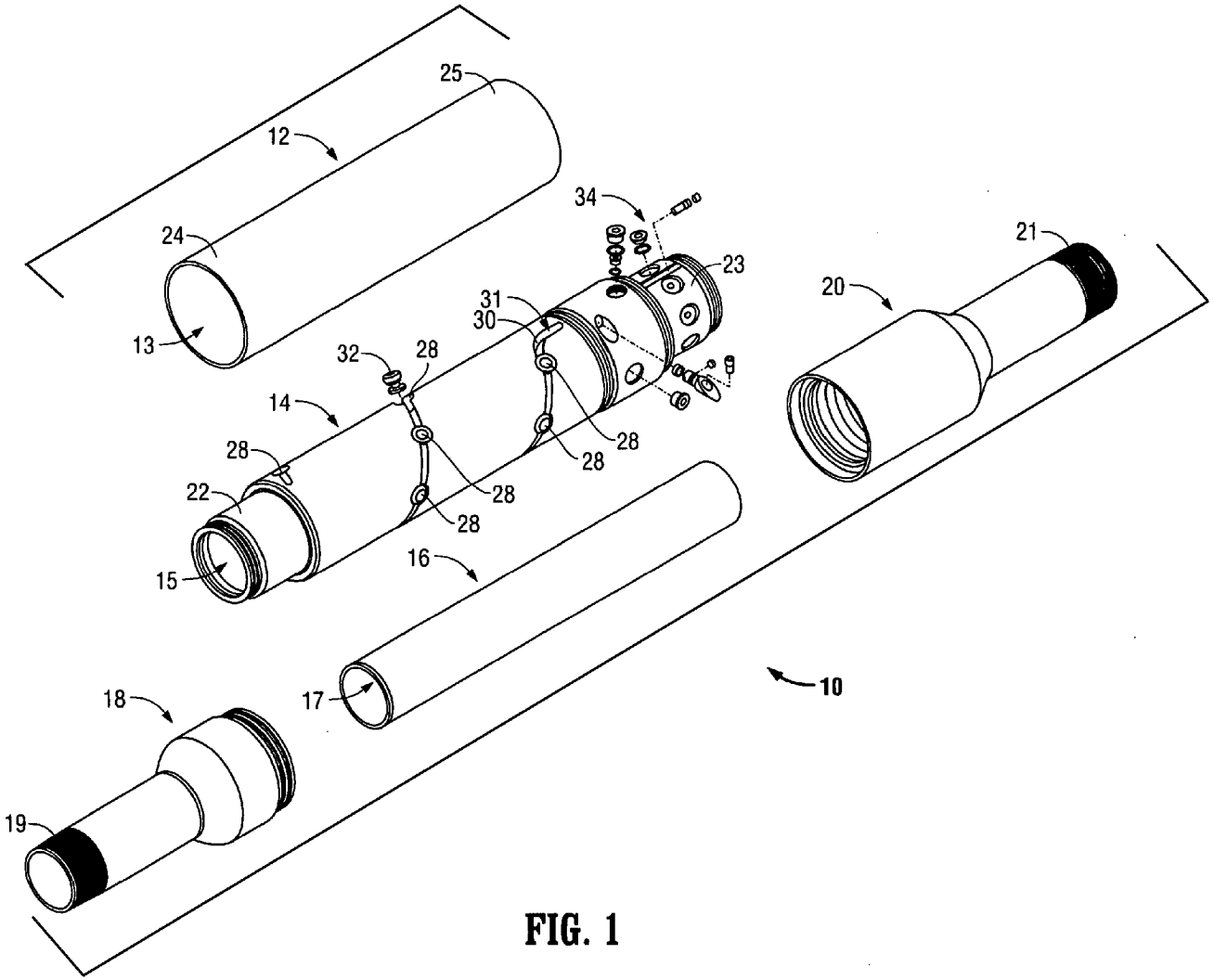
FIG. 1 depicts an isometric assembly view of an embodiment of a wellbore subassembly usable within the scope of the present disclosure.

Exemplary embodiments of a wellbore subassembly usable to create a flowpath between a wellbore conduit (e.g., a tubular string) and a formation are described herein with reference to the accompanying drawings, beginning with FIG. 1. FIG. 1 sets forth a drawing illustrating an isometric assembly view of an embodiment of a wellbore subassembly (10) usable within the scope of the present disclosure. The main components of the subassembly (10) can include an outer sleeve (12), depicted as a generally tubular member having an axial bore (13) therein, which can be positioned external to a core (14), which is also depicted as a generally tubular member having an axial bore (15) therein, such that when assembled, the core (14) occupies the axial bore (13) of the outer sleeve (12). The main components of the subassembly (10) can further include an inner sleeve (16) that is depicted as a tubular member having an axial bore (17) therein, which can be positioned internal to the core (14), such that when assembled, the inner sleeve (16) occupies the axial bore (15) of the core (14). Together, the outer sleeve (12), inner sleeve (16), and core (14) form the main body of the subassembly (10), which contains one or more charge assemblies usable to form a flowpath between a formation and a wellbore, e.g., by penetrating through the outer sleeve (12), into the formation, and through the inner sleeve (16) to enable fluid communication between the axial bore (17) thereof and the formation. It should be understood, however, that while the depicted embodiment of the subassembly (10) includes a core (14), outer sleeve (12), and inner sleeve (16) that are three discrete pieces, in an embodiment, one or both sleeves (12, 16) could be omitted and/or integral with the core (14). For example, sockets, which can be used to accommodate charge assemblies, could be sized to extend only partially through the thickness of the core (14), such that a portion of the wall of the core (14) remains to separate the socket from the interior and/or the exterior of the subassembly (10), such that a separate sleeve is not required to perform this function.

The depicted wellbore subassembly (10) may be conveyed along a tubular string (e.g., a casing string, a liner, a coiled tubing string, or any other tubular structure or conduit) through a wellbore and used to perforate a geological formation adjacent to the wellbore at the location of the subassembly (10). Specifically, FIG. 1 depicts a first end piece (18) and a second end piece (20) engageable to respective ends (22, 23, 24, 25) of the core (14) and the outer sleeve (12). Any number, type, and/or configuration of O-rings, snap rings, and/or similar sealing elements or connectors can be used to secure and/or create fluid-tight connections between the outer sleeve (12), core (14), inner sleeve (16), and end pieces (18, 20), such that wellbore fluid does not undesirably contact the core (14) and/or charge assemblies secured therein. The end pieces (18, 20) are securable to adjacent tubular members (e.g., joints of casing or similar portions/segments of a tubular conduit/string), such as through use of threaded connections (19, 21). As such, the subassembly (10), when engaged within a tubular string, can effectively become a part of the tubular string, the inner surface and axial bores of the end pieces (18, 20) and inner sleeve (16), forming a continuous fluid path with adjacent portions of the tubular string, such that wellbore fluid (e.g., produced hydrocarbons, fracturing fluid, stimulation fluid, etc.) can flow through both the tubular string and the subassembly (10) generally unimpeded. Similarly, the exterior surface of the outer sleeve (12) can serve a purpose similar to that of the exterior surface of adjacent tubular segments; for example, when the subassembly (10) is engaged with and lowered as part of a casing string, the exterior of the outer sleeve (12) becomes a part of the exterior of the casing string, forms a fluid/pressure barrier between the formation and the interior of the string, and can be cemented in place once positioned. The end pieces (18, 20) can have varying dimensions, and can be interchangeable, such that embodiments of the subassembly (10) can be adapted to engage tubular conduits of differing types and/or dimensions through engagement with an appropriately-sized end piece. The end pieces (18, 20) can further serve to distribute tensile forces (e.g., pulling forces) throughout the length of the subassembly (10).

As such, because the wellbore subassembly (10) of FIG. 1 is typically configured as part of a tubular string, the interior space of the wellbore subassembly (10) may be used to convey the variety of materials that typically pass through a tubular string during the lifecycle of a well. Such materials include, for example, water, treatment fluids, frac gels, hydrocarbons, or any other materials as will occur to those of skill in the art.

The core (14) of the subassembly (10), as well as the other components described above, are shown as generally tubular (e.g., cylindrical) because many wellbore components utilize this shape, but other shapes, as will occur to those of skill in the art, may be useful. In the embodiment shown in FIG. 1, the core (14) can be formed of a strong, but lightweight material, such as for example, aircraft aluminum. One skilled in the art, however, will recognize that other materials can be useful in wellbore subassemblies according to embodiments of the present invention such as, other types of aluminum, steel, carbon-based materials, and other similar materials.

An elongate cavity (30) is shown formed within the exterior surface of the core (14), the cavity (30) having a generally spiraled and/or "S" shape. Spaced along the length of cavity (30), a plurality of charge sockets (28) are formed, each socket configured to contain a charge assembly (e.g., charge assembly (32)). While the depicted cavity (30) includes three rows of charge sockets (28) generally evenly spaced about the circumference of the subassembly (10), it should be understood that the cavity (30) can have any dimensions and/or shape, and can include any number and configuration of sockets. In an embodiment, the shape of the sockets (28) can operate to minimize detonation interference among the charges contained therein, the walls of each socket (28) assisting in channeling the explosive forces from each charge radially inward toward the center of the wellbore subassembly (10), and/or radially outward therefrom, rather than permitting the explosive forces to flow laterally along the longitudinal length of the subassembly (10). During the assembly of the wellbore subassembly (10), charge assemblies (32), inserted into the sockets (28), can be held in place by frictional forces, O-rings, gaskets, or other similar methods of engagement as known in the art. Placement of the inner and outer sleeves (16, 12), about the core (14), can function to retain the charge assemblies (32) within the sockets (28).

The cavity (30) can be provided with detonation cord or similar means, used to connect the charge assemblies (32) within the sockets (28) to an initiation portion (34, shown in greater detail in FIG. 2C) located at one end (23) of the core (14), proximate to the leading end (31) of the cavity (30). As such, the charge assemblies (32) can be actuated to penetrate through the inner and outer sleeves (16, 12) and into a portion of a formation adjacent to the subassembly (10), to thereby provide a flowpath between the axial bore (17) of the inner sleeve (16) and the formation.

Flow through the axial bore (17), access to the initiation portion (34) and/or the cavity (30), and/or flow through perforations formed by actuating the charge assemblies (32) can be controlled via use of a shifting sleeve and flow control/isolation member (e.g., a ball, dart, plug, or other type of barrier retainable in a seat). For example a ball (38, shown in FIGS. 2C and 2D) or similar flow control element can be retained on a seat (40, shown in FIGS. 2C and 2D) to form an isolation barrier to allow fluid pressure to move a sleeve (36, shown in FIGS. 2C and 2D), and/or to fracture and/or otherwise flow fluid into and/or from a formation adjacent to the device. Shear pins (46, shown in FIG. 2F) can be used to restrain movement and/or rotation of the sleeve until the pins are sheared. In an embodiment, a preselected pressure and/or a preselected position/configuration of the sleeve and/or seat can allow the ball or other flow control element to pass the seat, e.g., for engagement with subsequent seats within other subassemblies; however, it should be understood that in various embodiments, a single subassembly can be used as a stand-alone apparatus.

Figure 2B:
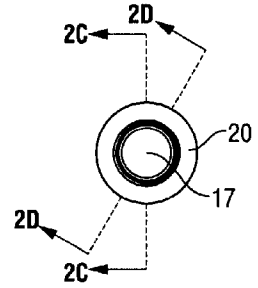
FIG. 2B depicts an end view of the wellbore subassembly of FIG. 1.
Figure 2A:
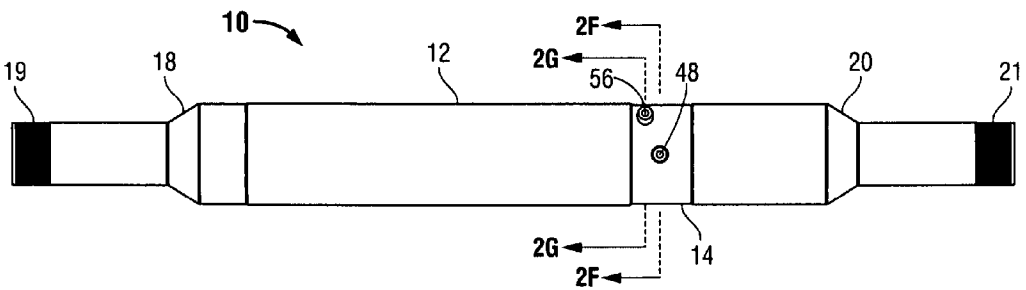
FIG. 2A depicts a side view of the wellbore subassembly of FIG. 1.

FIG. 2A depicts a side view of the wellbore subassembly (10) of FIG. 1, in which the outer sleeve (12) is shown positioned external to a portion of the core (14), and engaged with and/or abutting a first end piece (18) at one end. An exposed end of the core (14), within which a socket plug (48) and an initiator plug (56), usable to secure an initiator (not shown) in a desired position, are shown engaging and/or abutting the second end piece (20). (The socket plug (48) and initiator plug (56) are described in greater detail with reference to FIG. 2C). FIG. 2B depicts an end view of the subassembly (10), in which the second end piece (20) and the axial bore (17) are visible. When assembled, the threaded connections (19, 21, shown in FIG. 2A) on the respective end pieces (18, 20) can be usable to engage the subassembly (10) to adjacent portions of a tubular conduit (e.g., casing), such that the subassembly (10) can become, effectively, a portion of the conduit. The outer sleeve (12) can serve to cover the cavity (30) and charge sockets (28, shown in FIG. 1), protecting the charge assemblies (32) from exposure to fluid and/or conditions in the wellbore. Additionally, the outer sleeve (12) can operate to retain the charge assemblies (32, shown in FIG. 2D) and detonation cord in place, inside the cavity (30) and sockets (28). The inner sleeve (16) may operate to reduce interference among charge assemblies (32), because, as each charge assembly (32) detonates, the pressure from the detonation may deform nearby charge sockets and/or otherwise undesirably affect adjacent charge assemblies. As such, in an embodiment, the inner sleeve (16) can be formed from a material harder than that from which the core (14) is formed (e.g., the sleeve (16) could be formed from steel, while the core (14) is formed from aluminum). Further, the inner and outer sleeves (16, 12) can be adapted to provide the subassembly (10) with a desired burst and collapse rating, respectively, depending on various wellbore/formation conditions. While the inner and outer sleeves (16, 12), which in an embodiment can include liners, are shown in FIGS. 1, 2C and 2D, as generally cylindrical in shape, it should be understood that the sleeves and/or liners can have other shapes (e.g., rectangular), or any other geometric configurations to provide structural support to the subassembly (10) and/or to provide desired collapse and/or burst characteristics upon actuation of the charge assemblies (32).

Figure 2C:
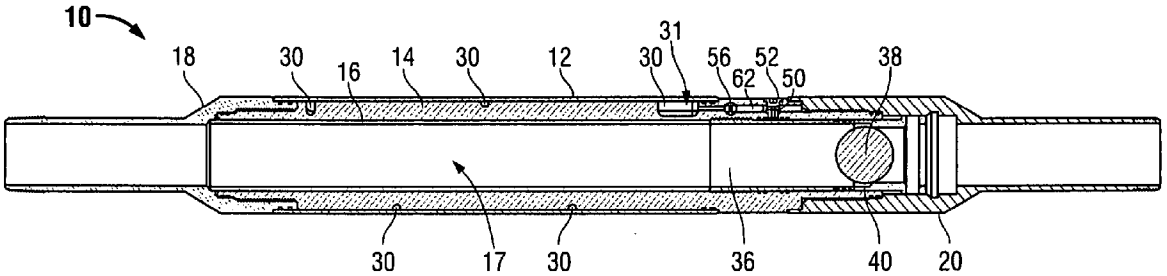
FIG. 2C depicts a side, cross-sectional view of the wellbore subassembly of FIGS. 2A and 2B, taken along line 2C of FIG. 2B.
Figure 2D:
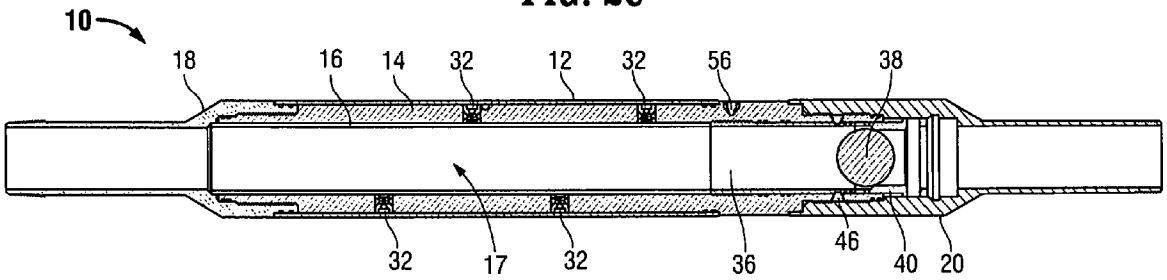
FIG. 2D depicts a side, cross-sectional view of the wellbore subassembly of FIGS. 2A and 2B, taken along line 2D of FIG. 2B.

FIG. 2C depicts a side, cross-sectional view of the wellbore subassembly (10) of FIGS. 2A and 2B, taken along line 2C of FIG. 2B, in which the outer sleeve (12) is shown positioned external to the core (14), which is shown positioned external to the inner sleeve (16). The first end piece (18) is shown engaged with a corresponding end of the outer sleeve (12), core (14), and inner sleeve (16), while the second end piece (20) is shown engaged with an end of the core (14), and positioned over the seat (40), and a portion of a shifting sleeve (36). The shifting sleeve (36) and seat (40) abut the inner sleeve (16) to form a generally contiguous flowpath through the subassembly (10) (e.g., axial bore (17)), through which fluid flow can be regulated by the position of the ball (38). Portions of the elongate conduit (30) are visible in FIG. 2C, and the leading end (31) of the conduit (30) is shown in communication with an internal conduit (62), extending through/within the wall of the core (14), that intersects the initiator plug (56) carrying the initiator, and a burst disc (50) and cover (52) therefore. As such, when the burst disc (50) is overcome, the leading end (31) of the conduit (30) can be placed in communication with a firing mechanism in the initiation portion (34, shown in FIG. 1) via the internal conduit (62), such that a detonation cord or similar means within the conduit (30) can be used to actuate the charge assemblies (32, shown in FIG. 1). Embodiments of usable firing assemblies are described in the co-pending U.S. patent applications having Ser. Nos. 12/804,517 and 13/136,085, incorporated by reference above, though any method and/or device for initiating the charge assemblies known in the art can be used without departing from the scope of the present disclosure.

In an embodiment, the initiation portion (34) can include an initiator secured within the end (23, shown in FIG. 1) of the core (14) via insertion of the initiator plug (56) into a corresponding cavity or socket in the core. A firing pin and/or similar means for actuating the firing mechanism can be positioned in association with the initiator. In operation, pressure within the axial bore (17) can be affected, e.g., by a surface operator, such that a pressure differential between the axial bore (17) and the space above the burst disc (50) can cause the burst disc (50) to rupture, thereby communicating pressure from the axial bore (17) to the firing pin and initiator, which in turn can ignite a detonation cord within the cavity (30) to cause actuation of the charge assemblies. In this manner, the burst disc (50) operates as a hydraulic pressure valve that opens when the pressure differential reaches a certain predetermined threshold that can be large enough to avoid accidental discharge of the subassembly. Other structures and mechanisms for initiating detonation of the charge assemblies as will occur to those of skill in the art may also be useful.

For example, in other embodiments, electrical signals, radio signals, fiber optic technology, hydraulic and/or pneumatic pressure, and any associated transmission and/or detection equipment can be used to initiate detonation of charge assemblies, via transmission of a certain signal (e.g., a threshold pressure level) or a certain sequence of signals. Other methods of actuating detonation of a charge known in the art are also usable without departing from the scope of the present disclosure.

FIG. 2D depicts a side, cross-sectional view of the wellbore subassembly (10) of FIGS. 2A and 2B, taken along line 2D of FIG. 2B. FIG. 2D shows the outer sleeve (12), core (14), inner sleeve (16), end pieces (18, 20), sleeve (36), seat (40), ball (38), and initiator plug (56) as shown in FIG. 2C; however, FIG. 2D is rotated approximately 30 degrees from that shown in FIG. 2C. Two shear pins (46), engaging the core (14) to the sleeve (36), are visible in FIG. 2D. The shear pins (46) can restrain movement and/or rotation of the sleeve (36), relative to the core (14), until sheared and/or otherwise overcome. The cross-sectional view shown in FIG. 2D, with the approximately 30 degree rotation from that shown in FIG. 2C, better illustrates four charge assemblies (32, shown in greater detail in FIG. 2E), which are positioned within corresponding sockets that intersect the cavity (30, shown in FIG. 2C), are visible.

It should be understood that the dimensions of each portion of the subassembly (10) can vary depending on various factors, such as the type and dimensions of tubular conduit to which the subassembly (10) is engaged, the dimensions of the wellbore, the conditions of the wellbore and/or formation, etc. As such, the apparent dimensions shown in FIGS. 2A-2D are merely on exemplary embodiment.

Figure 2E:
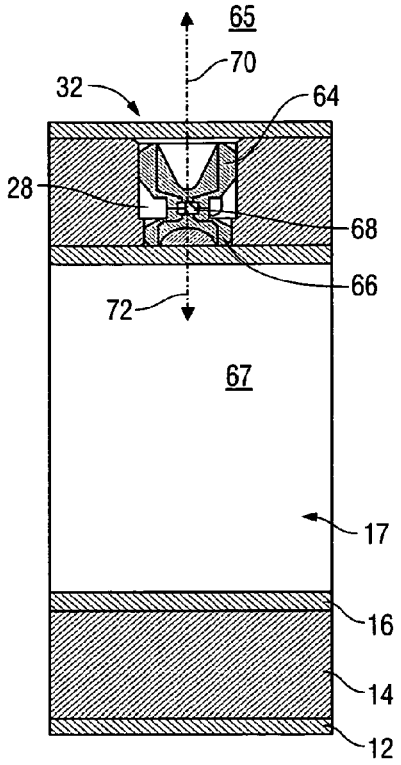
FIG. 2F depicts an end, cross-sectional view of the wellbore subassembly of FIG. 2A, taken along line 2F thereof.
FIG. 2G depicts an end, cross-sectional view of the wellbore subassembly of FIG. 2A, taken along line 2G thereof.

FIG. 2E depicts a partial, side, cross-sectional view of the wellbore subassembly of FIG. 2D, showing a charge assembly (32) thereof, positioned within a socket (28) formed within the core (14), positioned between the outer and inner sleeves (12, 16), respectively. While the configuration of the charge assembly (32) can vary depending on the dimensions and characteristics of the sleeves (12, 16) and/or other portions of the subassembly (10), and those of the wellbore and/or the formation, FIG. 2E depicts the charge assembly (32) having a first charge (64) configured to discharge into the space (65) exterior to the subassembly (10) (e.g., into the formation and/or through any intervening structures, such as the outer sleeve (12), any additional tubular conduits located external to the subassembly, and/or cement or other similar barrier materials), and a second charge (66) configured to discharge into the space (67) interior of the subassembly (10) (e.g., through the inner sleeve (16) into the axial bore (17)). A channel (68) is defined between the first and second charges (64, 66) for accommodating a detonation cord or similar medium. In an embodiment, the first and second charges (64, 66) can be positioned at substantially the same position along the length of the subassembly (10) (e.g., at substantially the same depth in a wellbore), such that actuation of the first and second charges (64, 66) can occur virtually simultaneously.

When actuated, the first charge (64) can be configured to discharge along the path indicated by the arrow (70), penetrating through the outer sleeve (12) and any other objects and/or media located external to the subassembly, such as additional tubular conduits or cement, then into the adjacent formation and to a desired distance (e.g., 4-6 inches). The second charge (66) can be configured to discharge along the path indicated by the arrow (72), penetrating through the inner sleeve (16) and into the axial bore (17). In an embodiment, the distance penetrated by the second charge (66) can be less than that penetrated by the first charge (64). During typical use, the distance penetrated by the second charge (66) (e.g., 2 inches or less) is limited such that the second charge (66) does not penetrate the opposing side of the inner sleeve (16) upon actuation or otherwise negatively affect the inner surface of the subassembly (10), though in other embodiments, the second charge (66) can be configured to penetrate the opposing side of the subassembly (10) and/or into the formation. In an embodiment, the second charge (66) can be configured to provide the inner sleeve (16) with an opening having a diameter larger than that provided to the outer sleeve (12) by the first charge (64). For example, the second charge (66) could be configured to provide large-hole, small-penetration, while the first charge (64) is configured to provide medium-hole, large-penetration.

While the dimensions of each portion of the subassembly can vary depending on various factors (e.g., the type and dimensions of tubular conduit to which the subassembly is engaged, the dimensions of the wellbore, wellbore and/or formation conditions, the desired penetration distance, the opening diameter desired in the sleeves (12, 16), etc.), the charge assembly (32) and socket (28) can have a diameter selected to correspond to the type and/or dimensions of the charges (64, 66) to be contained therein, and/or to effect the characteristics of the detonation of the charge.

Figure 2F:
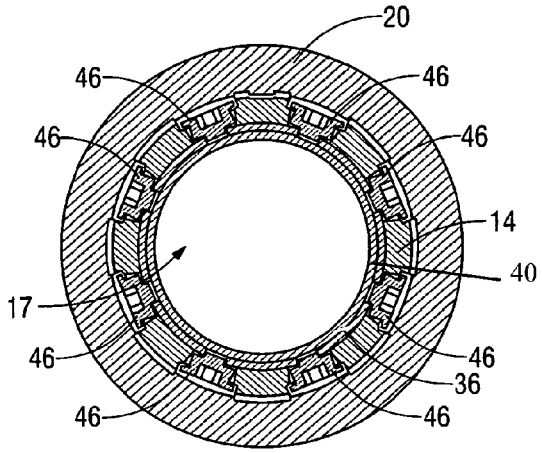

FIG. 2F depicts an end, cross-sectional view of the wellbore subassembly of FIG. 2A, taken along line 2F thereof, showing the second end piece (20) positioned external to the core (14), which is in turn positioned external to the shifting sleeve (36), which is generally contiguous with the axial bore (17) of the inner sleeve, as described above. A plurality of shear pins (46), engaging the core (14) to the shifting sleeve (36), are shown, each shear pin (46) extending through a corresponding socket to engage a portion of the shifting sleeve (36), to thereby prevent rotation and/or movement of the shifting sleeve (36) relative to the core (14), until the shear pins (46) are sheared and/or otherwise overcome. While FIG. 2F depicts eight shear pins (46), generally equally spaced about the circumference of the core (14), it should be understood that any number and configuration of shear pins or other frangible and/or movable elements can be used to selectively restrain or allow relative movement between the core (14) and shifting sleeve (36) without departing from the scope of the present disclosure.

Figure 2G:
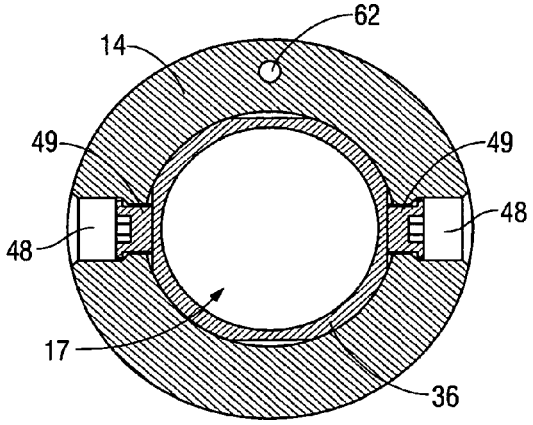

FIG. 2G depicts an end, cross-sectional view of the wellbore subassembly of FIG. 2A, taken along line 2G thereof, showing the core (14) positioned external to the shifting sleeve (36), which is generally contiguous with the axial bore (17) of the inner sleeve, as described above. Two socket plugs (48) are shown within corresponding cavities (49), on opposing sides of the core (14), positioned generally ninety degrees from the location of the channel (62). It should be understood, however, that the depicted arrangement of components is only exemplary, and that any number and/or arrangement of socket plugs, including zero, can be used without departing from the scope of the present disclosure.

In use, an embodiment of the wellbore subassembly (10), such as that shown in FIG. 2A, can be engaged, at each end thereof, to segments of a tubular conduit (e.g., joints of casing) using the threaded connections (19, 21) on the end pieces (18, 20) or other similar means of engagement. The subassembly (10) can then be inserted into a wellbore to a desired position/depth, either within an existing tubular string or directly adjacent to the formation. If desired and/or necessary, the subassembly (10) can be cemented into place when the attached tubular conduit is cemented. The subassembly (10) can remain in the desired position until perforation is desired and/or necessary, effectively functioning as part of the tubular conduit to which it is engaged. As such, multiple wellbore subassemblies (10) can be provided into a wellbore, each subassembly being individually actuated to perforate a formation and create a flowpath between the perforation and the interior of the subassembly (10) as needed, while other subassemblies may selectively not be actuated until a later time. It should be understood, however, that a single subassembly can be used in a stand-alone capacity as well.

When it is desired to create a flowpath between the formation adjacent to the subassembly (10) and the wellbore, a firing mechanism can be actuated to cause an initiator in the initiation portion (34), and an associated detonation cord or similar media positioned in the cavity (30), to sequentially cause actuation and discharge of the charge assemblies (32) positioned along the length thereof. Each charge assembly (32) can include first and second charges (64, 66), configured to discharge generally simultaneously, the first charge (64) penetrating through the outer sleeve (12) of the subassembly (10) (and cement and/or any other tubular conduits located external thereto) into the formation, while the second charge (66) penetrates through the inner sleeve (16) of the subassembly (10), into the axial bore (17) thereof, to create a flowpath between the axial bore (17) and the formation. When it is desired to regulate fluid flow through the axial bore (17) of the subassembly (10) (e.g., to fracture, stimulate, and/or produce the formation adjacent to the subassembly (10)), and/or to block the perforated openings, the shifting sleeve (36) and/or ball (38) and seat (40) can be utilized for this purpose, such as through use of the ball (38) or similar flow control element to form an isolation barrier to allow an increase in pressure within the subassembly (10), or through movement of the shifting sleeve (36) relative to the core (14) to shear the shear pins (46). As such, after the charge assemblies (32) have discharged, the subassembly (10) remains usable as a portion of the tubular conduit to which it is engaged, effectively becoming a "disappearing" perforating gun.

Arcuate and lateral portions of wellbores can create specific problems, especially with respect to perforating. Further, the longer the lateral portions of a borehole, the more difficult it can be to achieve effective perforations. However, these problems can be resolved by embodiments of the subassemblies and methods described herein. Thus, as drilling practices are directed more toward directional drilling, and directional drilling creates more and longer lateral well bores, the need for the effective perforating techniques as defined in the present disclosure increase. Embodiments of the present subassemblies and methods do not require secondary control lines that extend to the surface, and are easy to install and use, while providing a "disappearing" perforating device that is unobtrusive after it has been used.

The characteristics of the perforation achieved by the embodiments of the present disclosure are greatly enhanced. Particularly, the achievement of a continuous, normal perforation, free from disruption, has been achieved using a combination of structural features (e.g., the presence of inner and outer sleeves, the materials from which the sleeves and/or the core are formed, the shape of the charge sockets, etc.). Still further, the present subassemblies and methods reduce the costs, are less time consuming, reduce the manpower needs and are significantly less prone to safety problems when compared to conventional alternatives.

While certain exemplary embodiments have been described in details and shown in the accompanying drawings, it is to be understood that such embodiments are merely illustrative of and not devised without departing from the basic scope thereof, which is determined by the claims that follow.

We claim:

1. A wellbore subassembly comprising:

a tubular core defining a core axial bore in the interior of the core, and an exterior space outside the core, said core comprising a tubular wall with one or more cavities therein configured to hold one or more charge assemblies, and a first end and a second end wherein the first end and second end are configured to connect the core to a tubular drill string such that the core axial bore provides a substantially continuous fluid channel from a drill string connected to said first end, through the core and into a drill string connected to said second end, a first tubular sleeve forming an outer sleeve axial bore and positioned over the core to contain at least a portion of the core inside the outer sleeve axial bore, and one or more charge assemblies in the one or more cavities configured to discharge into the core axial bore and into the exterior space outside the core for creating a flowpath between the core axial bore and the exterior space outside the core.

2. The subassembly of claim 1, further comprising a second tubular sleeve defining a second sleeve axial bore positioned within the core axial bore.

3. The subassembly of claim 2, wherein the charge assembly is configured to discharge into the core axial bore and to penetrate through the second tubular sleeve.

4. The subassembly of claim 1, wherein the charge assembly is configured to discharge into the exterior space and penetrate through the first tubular sleeve.

5. The subassembly of claim 1, wherein the charge assembly comprises a first charge configured to discharge into the core axial bore and a second charge configured to discharge into the exterior space outside the core.

6. The subassembly of claim 5, wherein the first charge and the second charge are configured to discharge simultaneously.

7. The wellbore subassembly of claim 1, wherein the core further comprises a first end piece and a second end piece with threaded connectors connecting the first and second ends of the core to the tubular drill string.

8. A method for creating a flowpath between a wellbore and a formation, the method comprising the steps of engaging a wellbore subassembly with a tubular string, wherein the wellbore subassembly comprises a tubular core defining a core axial bore in the interior of the core, and an exterior space outside the core, said core comprising a tubular wall with one or more cavities therein configured to hold one or more charge assemblies, and a first end and a second end wherein the first end and second end are configured to connect the core to a tubular drill string such that the core axial bore provides a continuous fluid channel from a drill string connected to said first end, through the core and into a drill string connected to said second end, and a charge assembly in the cavity configured to discharge into the interior space and into the exterior space; lowering the wellbore subassembly to a selected position in the wellbore; and actuating the charge assembly such that the charge assembly discharges into the interior space and into the exterior space to create a flowpath between the interior space and the exterior space, wherein the tubular core comprises a channel for accommodating a detonation cord that extends between the charge assembly and a firing assembly, and wherein actuating the charge assembly comprises actuating the firing assembly to ignite the detonation cord, thereby causing the charge assembly to discharge into the core axial bore and into the exterior space outside the core.

9. The method of claim 8, wherein the tubular body comprises an outer sleeve between the cavity and the exterior space, an inner sleeve between the cavity and the interior space, or both of said outer sleeve and said inner sleeve, and wherein actuating the charge assembly causes the charge assembly to penetrate through the outer sleeve, the inner sleeve, or combinations thereof.

10. The method of claim 8, wherein the charge assembly comprises a first charge configured to discharge into the interior space and a second charge configured to discharge into the exterior space, wherein the first charge and the second charge engage a single portion of the detonation cord, and wherein actuating the charge assembly causes the first charge and the second charge to discharge simultaneously.

11. The method of claim 8, wherein the core further comprises a first end piece and a second end piece with threaded connectors connecting the first and second ends of the core to the tubular drill string.

* * * * *